US012559290B2

(12) United States Patent
Downey

(10) Patent No.: US 12,559,290 B2
(45) Date of Patent: Feb. 24, 2026

(54) REUSEABLE GIFT WRAP

(71) Applicant: Meagan Downey, Shelburne, VT (US)

(72) Inventor: Meagan Downey, Shelburne, VT (US)

( * ) Notice: Subject to any disclaimer, the term of this patent is extended or adjusted under 35 U.S.C. 154(b) by 0 days.

(21) Appl. No.: 17/235,400

(22) Filed: Apr. 20, 2021

(65) Prior Publication Data

US 2022/0073245 A1 Mar. 10, 2022

Related U.S. Application Data

(60) Provisional application No. 63/076,424, filed on Sep. 10, 2020.

(51) Int. Cl.
*B65D 65/22* (2006.01)
*B65D 65/04* (2006.01)

(52) U.S. Cl.
CPC ..... *B65D 65/22* (2013.01); *B65D 65/04* (2013.01); *B65D 2565/384* (2013.01)

(58) Field of Classification Search
CPC ... B65D 65/22; B65D 65/04; B65D 2565/384
USPC ..... 229/87.07
See application file for complete search history.

(56) References Cited

U.S. PATENT DOCUMENTS 3,024,824 A * 3/1962 Bass ..... D06F 95/004 294/149
3,355,092 A * 11/1967 Le Pain ..... B65D 5/62 229/87.19
4,620,396 A * 11/1986 Bjorntwedt ..... B65D 75/14 428/33
5,004,144 A 4/1991 Selga
5,407,125 A 4/1995 Yates et al.
5,904,289 A * 5/1999 Hagan ..... B65D 65/14 229/87.19
5,934,548 A * 8/1999 Kenyon ..... B65D 65/02 229/116.5
6,092,932 A * 7/2000 Pekala ..... A45C 13/42 40/6
6,647,697 B1 * 11/2003 Zarrow ..... B65D 75/08 206/466
7,077,308 B2 * 7/2006 Beach ..... B65D 67/00 383/66
7,811,649 B2 * 10/2010 Post ..... A47L 13/51 206/820
7,926,702 B2 * 4/2011 Childs ..... B65D 29/00 383/105
8,783,546 B2 * 7/2014 Uyehara ..... B65D 65/06 229/87.01
8,813,796 B2 * 8/2014 Gilbert ..... B65D 65/02 24/30.5 R
8,931,242 B1 * 1/2015 Sardo ..... B65B 51/04 383/71

(Continued)

FOREIGN PATENT DOCUMENTS

GB 2495773 * 4/2013

*Primary Examiner* — Peter N Helvey
(74) *Attorney, Agent, or Firm* — Michael Best & Friedrich LLP

(57) ABSTRACT

Reuseable gift wrap is a sheet of material formed from a resilient and stretchable fabric material comprising recycled plastic. The sheet of material includes a first side having a first design and an opposite second side having a second design. The sheet of material is configured to cover an object without distortion of the first design and the second design after stretching to cover the object.

14 Claims, 6 Drawing Sheets

(56) References Cited

U.S. PATENT DOCUMENTS

| | | | | |
|---|---|---|---|---|
| 9,174,783 | B1 | 11/2015 | Grabell et al. | |
| 9,180,651 | B1 * | 11/2015 | Pepin | B65B 53/02 |
| 9,365,337 | B2 * | 6/2016 | Fullan | B65D 65/06 |
| D782,919 | S | 4/2017 | Grabell et al. | |
| D792,238 | S | 7/2017 | Grabell et al. | |
| 11,203,474 | B2 * | 12/2021 | Sawicki | B65D 67/00 |
| 11,420,800 | B2 * | 8/2022 | Laflamme | B65D 63/10 |
| 2004/0026488 | A1 * | 2/2004 | Beach | B65D 67/00 229/87.19 |
| 2006/0174525 | A1 * | 8/2006 | Hughes | G09F 17/00 40/603 |
| 2007/0041670 | A1 * | 2/2007 | Spizman | B65D 75/006 383/118 |
| 2012/0012646 | A1 * | 1/2012 | Bissonnette | B65D 65/22 53/461 |
| 2013/0037188 | A1 * | 2/2013 | Grundleger | B65D 75/06 150/154 |
| 2013/0186782 | A1 | 7/2013 | Doyle | |
| 2013/0186896 | A1 * | 7/2013 | Doyle | B65D 5/4262 220/259.1 |
| 2015/0246763 | A1 | 9/2015 | Nowak | |
| 2017/0259973 | A1 | 9/2017 | Crossno et al. | |
| 2021/0171258 | A1 * | 6/2021 | Sawicki | B65D 67/00 |
| 2021/0237927 | A1 * | 8/2021 | Fiore, Jr. | B65D 5/38 |
| 2022/0073245 | A1 * | 3/2022 | Downey | B65D 65/22 |
| 2022/0135300 | A1 * | 5/2022 | Laflamme | B65D 65/10 229/87.01 |

* cited by examiner

REUSEABLE GIFT WRAP

CROSS-REFERENCE TO RELATED APPLICATIONS

This application is a non-provisional of and claims the benefit of U.S. Provisional Patent Application No. 63/076,424, filed on Sep. 10, 2020, the entire contents of which are incorporated herein by reference.

BACKGROUND

Gift-giving occurs throughout the year to mark holidays, birthdays, and special occasions. Many people enjoy buying gifts, but also wrapping them in beautiful wrapping paper with ribbons, bows, and fancy tags. Gift wrap adds a layer of beauty and anticipation to every gift. Kids and adults enjoy opening gifts by tearing through the paper to discover the treasure inside.

Gift wrap is generally understood to mean decorative paper for wrapping a present. Gift wrap is popular to conceal or decorate packages or objects generally intended to be given as a gift. Other forms of gift wrap include boxes or gift bags.

Gifts are typically wrapped using a number of steps and a variety of paper wrapping materials. For example, the paper gift wrap is cut to size before being folded around the package, then held in place while transparent adhesive tape is applied across the overlapping edges to secure the wrapping around the gift. The conventional wrapping process can be time consuming, cumbersome, and wasteful.

Traditionally, gift wrap is made of paper and is intended as single-use and thrown in the trash. Some people will try to carefully open a gift-wrapped package to save and reuse the gift wrap on another gift. However, it is estimated that, in the United States, four million tons of waste in wrapping paper and shopping bags are generated over the Christmas gift-giving period each year. Additionally, most paper wrap and adhesive tape is not recyclable. Accordingly, it is desirable to find an ecologically friendly alternative to wrapping paper.

SUMMARY

Disclosed herein is a reuseable gift wrap that provides a sustainable solution to paper giftwrap. The reuseable gift wrap is a fabric material derived from recyclable plastic. The subject matter of this disclosure provides an alternative to the wasteful, paper material. Of particular interest are embodiments that are not only re-usable, but also utilize materials that are more sustainable to protect our fragile environments.

The embodiments described herein include a material sheet that is configured to wrap or cover objects. These configurations may embody a thin, flat piece of material. Other configurations may take certain forms as a "receptacle," for example, a bag, box, pouch, or like arrangement of the materials that can hold the object and provide substantial coverage to obscure the object from view. The materials may have compositions that are environmentally-friendly, for example, made of fibers of recycled plastics, paper, or other feedstock. The material may be malleable or flexible to allow the sheet to fold, bend, or conform to the object. These properties are beneficial to obscure the object from view "underneath" the material sheet. When removed, the material sheet may retain its original shape for re-use on a different object.

In one embodiment, the present disclosure provides reuseable gift wrap comprising a sheet of material formed from a resilient and stretchable fabric material comprising a majority of recycled plastic, the sheet of material including a first side and an opposite second side. The first side includes a first design and the second side includes a second design, and the sheet of material is configured to cover an object without distortion of the first design and the second design after stretching to cover the object.

In another embodiment, the present disclosure provides reuseable gift wrap comprising a flat sheet of material formed from a resilient and stretchable fabric material comprising a majority of recycled plastic, the sheet of material including a first side and an opposite second side. The first side includes a first design and the second side includes a second design, wherein the sheet of material defines a perimeter having a laser cut edge, and the sheet of material is configured to cover an object and remain flat after the sheet is removed from the object.

DETAILED DESCRIPTION

Figure 1:
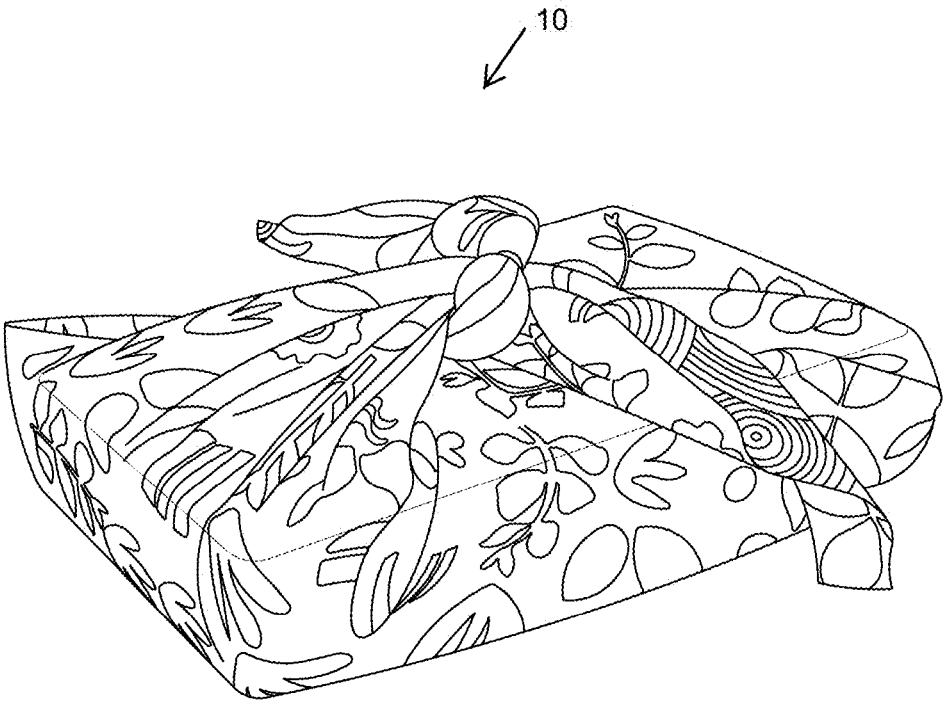
FIG. 1 illustrates a sheet of reuseable gift wrap applied to an item or gift according to one embodiment of the present disclosure.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. The materials, methods, and examples disclosed herein are illustrative only and not intended to be limiting.

For the recitation of numeric ranges herein, each intervening number therebetween with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

Figure 2:
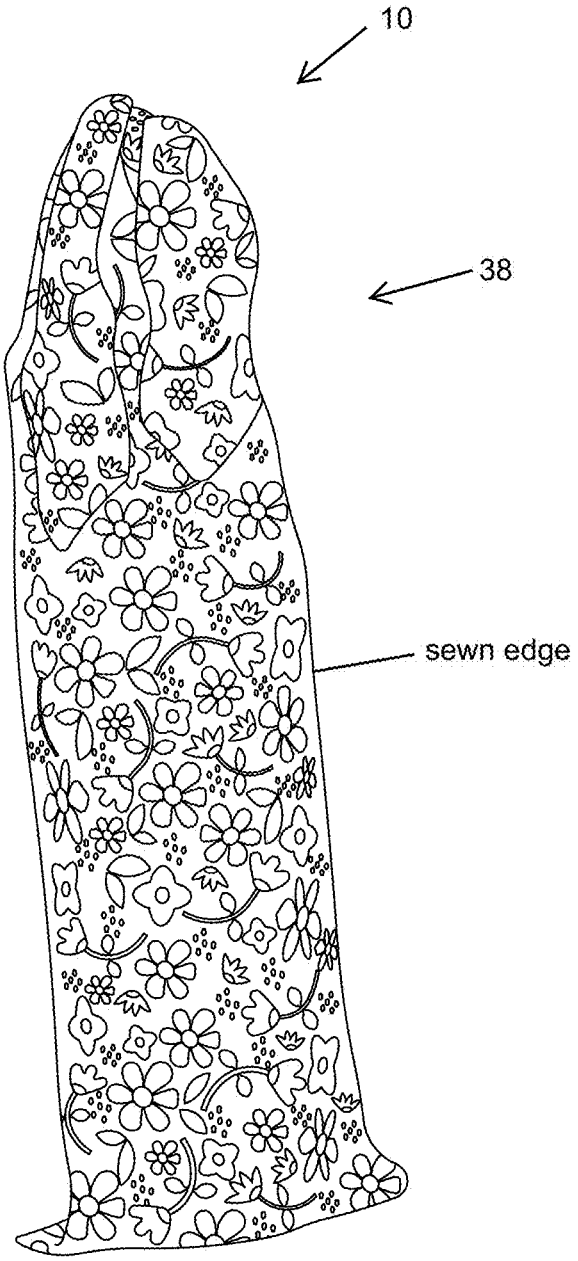
FIG. 2 illustrates a sheet of reuseable gift wrap of FIG. 1 formed as a gift bag.
Figure 3:
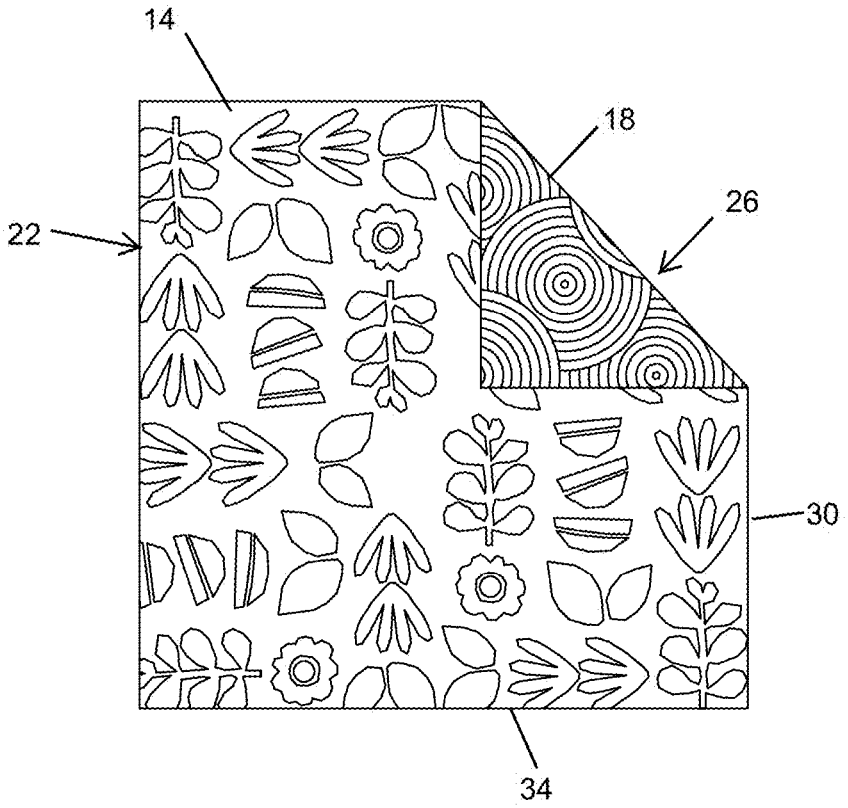
FIG. 3 illustrates the sheet of reuseable gift wrap shown in FIG. 1.
Figure 4:
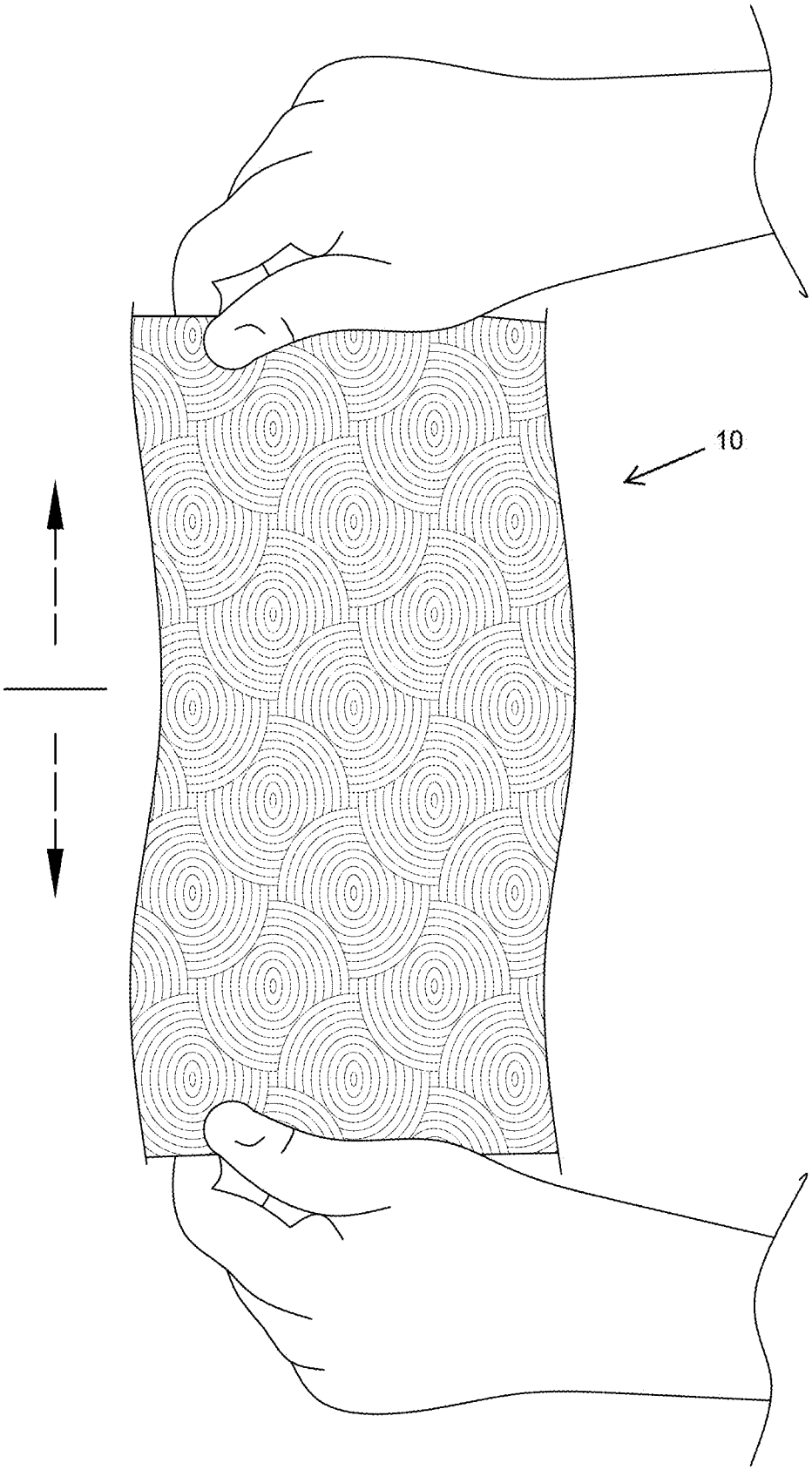
FIG. 4 illustrates the sheet of reuseable gift wrap of FIG. 1 in a stretched configuration.

FIGS. 1-4 illustrate a sheet of reuseable gift wrap 10 according to an embodiment of the present disclosure. FIG. 1 illustrates the reuseable gift wrap 10 applied to or wrapped around a gift 12. FIG. 2 illustrates the reuseable gift wrap 10 in the form of a gift bag. As illustrated in FIG. 3, the sheet of reuseable gift wrap 10 is square in shape, however other shapes are contemplated as well. For example, the sheet of reuseable gift wrap 10 may be shaped as a rectangle, triangle, circle, oval, cross, or the like. In a square construction, the size or length of each side may be about 12" to about 48". In other square constructions, the size or length of each side may be about 18" to about 36". In other constructions, and as illustrated in FIG. 2, the sheet of reuseable gift wrap 10 may be arranged as a bag to accommodate many different shaped items, e.g., wine bottle, toys, and uncommonly shaped items, where a bag may make the gift wrapping process easier and quicker.

With reference to FIG. 3, the sheet of reuseable gift wrap 10 comprises a fabric material. The fabric material may be cotton, silk, linen, canvas, polyester, satin, Spandex, synthetic materials, or other suitable types of woven or knit fabric. In particular, the sheet of reuseable gift wrap 10 comprises recycled plastic. The recycled plastic in the sheet 10 comprises a majority (i.e., greater than 50%) of the material. In one embodiment, the fabric material comprises REPREVE® recycled polyester spandex. In one embodiment, the fabric material is woven with about 70%-80% REPREVE recycled polyester spandex. In one embodiment, the fabric material is woven with 78% REPRIEVE recycled polyester, 22% spandex.

The sheet of reuseable gift wrap 10 includes a first side 14 (e.g., top side) and a second side 18 (e.g., bottom side or reverse side). The sheet of reuseable gift wrap 10 includes a first design 22 on the first side 14 and a second design 26 on the second side 18. The first design 22 and the second design 26 may be the same or different. The first design 22 and the second design 26 may include any type of design or pattern. The design or pattern may include a picture, a repeating pattern (stripes, plaid, polka dots, tartan, paisley, and the like), an abstract, an animal print, and the like, and may include one or more colors. For example, the first design 22 and the second design 26 may be holiday-themed, birthday-themed, or any desirable themed design. The number and color of designs 22, 26 are endless.

The sheet of reusable gift wrap 10 includes a single layer having a first side 14 (e.g., top side) and a second side 18 (e.g., bottom side or reverse side). The sheet of reusable gift wrap 10 includes a first design 22 on the first side 14 and a second design 26 on the second side 18. The first design 22 and the second design 26 may be the same or different. The first design 22 and the second design 26 may include any type of design or pattern. The design or pattern may include a picture, a repeating pattern (stripes, plaid, polka dots, tartan, paisley, and the like), an abstract, an animal print, and the like, and may include one or more colors. For example, the first design 22 and the second design 26 may be holiday-themed, birthday-themed, or any desirable themed design. The number and color of designs 22, 26 are endless.

Unlike screen printing or other processes where the designs would distort or flake off with continued reuse, the sheet of reuseable gift wrap 10 utilizes an eco-friendly dye sublimation process where ink is heat transferred into the fabric, changing from a solid to a gas (hence the term "sublimation") and enters/permeates the recycled plastic fibers. The end result is a nearly permanent, high resolution, full color print. Because the dyes are infused into the substrate at a molecular level rather than applied at a topical level (such as with screen printing and direct to garment printing) the prints do not crack, fade or peel from the substrate over multiple uses.

The dye-sublimation process also results in an even texture that allows the sheet 10 to remain soft and inviting to the touch for ease of wrapping. The fabric is dyed on both sides, allowing a reversible wrap with two distinct patterns per sheet 10. The sheet 10 defines a perimeter 30 having an edge 34. The printed fabric is then laser cut, cauterizing the edges for clean lines with no hem or excess materials (thread, etc.) imposing on the wrapping process or needing to be finished.

Figure 5:
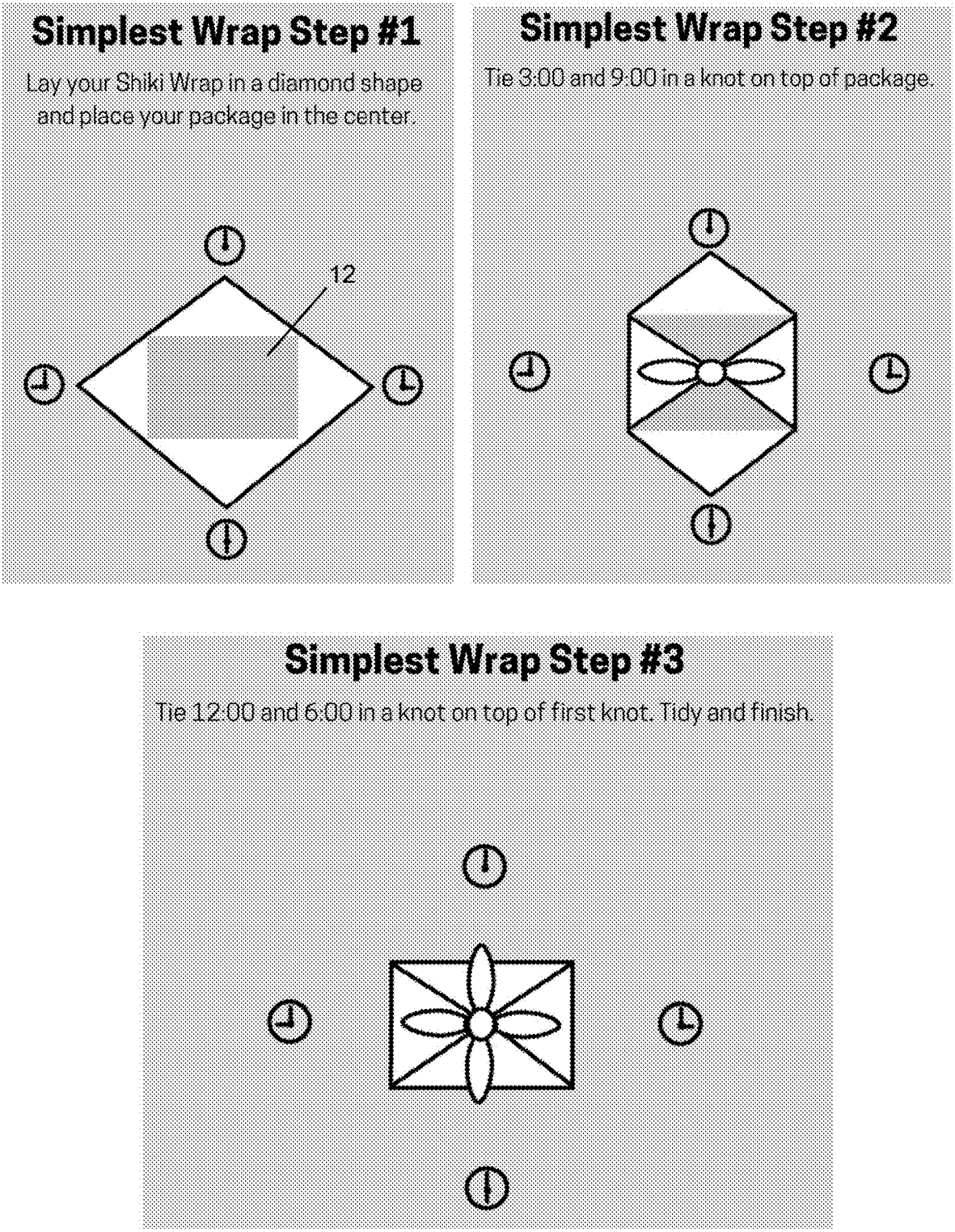
FIG. 5 illustrates a method of folding the sheet of reuseable gift wrap of FIG. 1.

The sheet of reuseable gift wrap 10 is flat and is manipulated in various ways to conceal or cover the gift. In one example, the sheet 10 can be manipulated and tied in a number of ways, the simplest tie is simply two knots. As illustrated in FIG. 5, two of the opposite corners are brought together over the gift and tied in a first knot and then the two remaining opposite corners are brought together over the gift and tied in a second knot thereby forming a bow-like structure in the middle of the gift. Because of the sheet's 10 stretch and versatility, it can also be used for odd-shaped objects such as slippers, cutting boards, vases, etc. It is noted that upon unwrapping of the gift, no fold lines are apparent in the sheet 10 and remains flat for a future gift to be wrapped.

Figure 6:
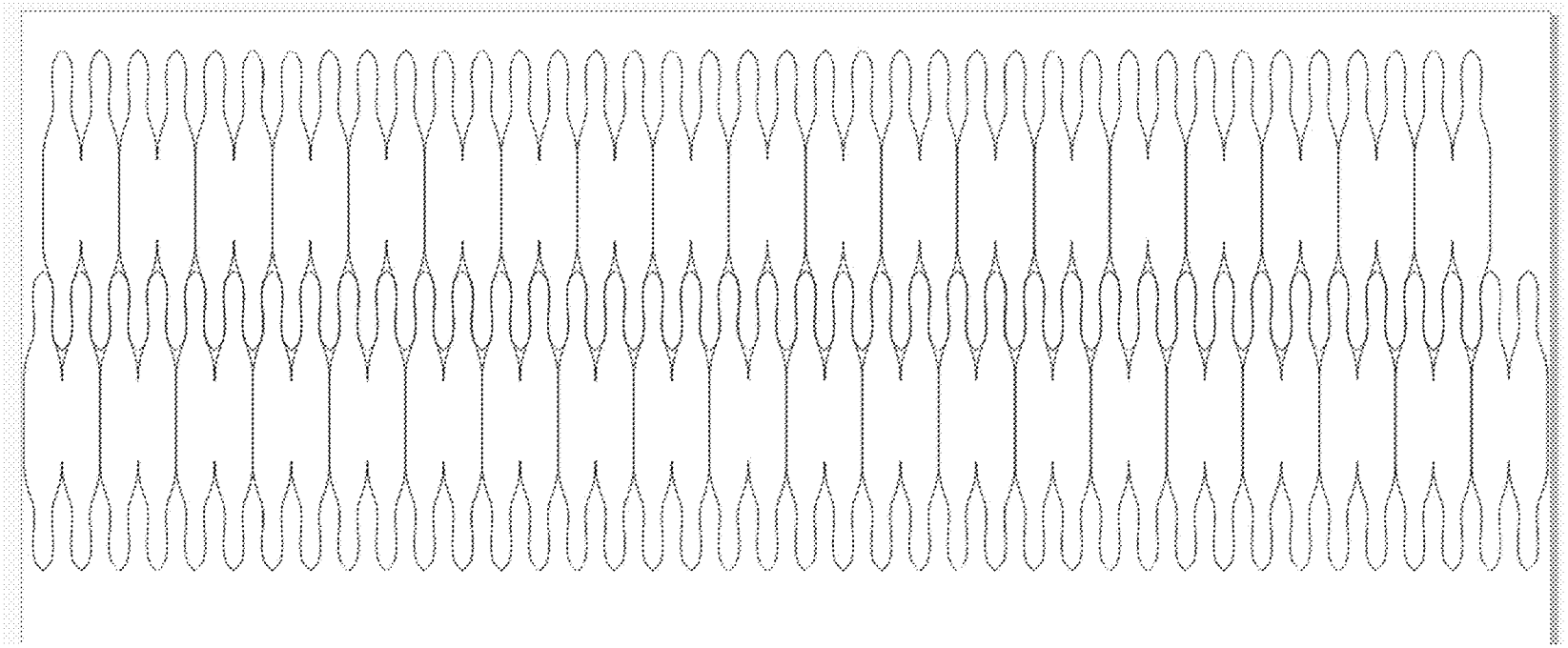
FIG. 6 illustrates a fabric blank for cutting a gift bag reuseable gift wrap shown in FIG. 2.

As illustrated in FIG. 6, a sheet 10 layout is shown for generating a plurality of gift bags 38. Each gift bag 38 is sewn up the sides and simply tied at the top for closure. The negative space between the cuts for the bags can be used for ribbon and ornamental pieces, maximizing yield and eliminating waste.

The sheet of reuseable gift wrap 10 fills a long-held need in the gift wrap industry for a sustainable, attractive alternative to paper gift wrap. Alternatives include non-stretchy, hemmed furoshiki that is difficult to tie, newsprint, and unattractive, distortable recycled materials.

The sheet of reuseable gift wrap 10 is different from other fabric-based gift wrap in that it has no extra ties or fasteners—the sheet 10 is simply tied around the object. It is also different in that it utilizes fabric derived from recycled plastic.

The sheet of reuseable gift wrap 10 was formally studied by a group in Japan that is dedicated to the art of gift wrapping with textiles. The group reported that the stretchiness is unique to the product. Additionally, a Japanese furoshiki expert wrote the following about the sheet 10: "It's the first time I've ever felt the fabric that stretches to the color pattern."

Various features and advantages of the invention are set forth in the following claims.

What is claimed is:

1. Reuseable gift wrap comprising:

a sheet of material formed from a resilient and stretchable fabric material comprising a majority of recycled plastic, the sheet of material woven with a flexible recycled material, the sheet of material including a single layer having a first side and an opposite second side, wherein the first side includes a first design and the second side includes a second design, wherein the sheet of material is configured to cover an object without distortion of the first design and the second design after stretching to cover the object, wherein the sheet of material is configured to be tied around the object without the use of a fastener, wherein the first design and the second design are different, wherein the sheet of material further includes a perimeter defining a laser cut edge, wherein the flexible recycled material includes a recycled polyester and spandex material, wherein the flexible recycled material includes at least 70% of the recycled polyester, and wherein the sheet of material is configured to stretch at least 40% of an initial dimension in a direction of pull without distortion of the first design and the second design.

2. The reuseable gift wrap of claim 1, wherein the sheet of material is square.

3. The reuseable gift wrap of claim 2, wherein the square is about 12"×12" to about 48"×48".

4. The reuseable gift wrap of claim 3, wherein the square is about 18"×18" to about 36"×36".

5. The reuseable gift wrap of claim 1, wherein the first design and the second design are generated with a dye sublimation process.

6. The reuseable gift wrap of claim 1, wherein the sheet of material further includes a perimeter having a hemless edge.

7. Reuseable gift wrap comprising:

a flat sheet of material formed from a resilient and stretchable fabric material comprising a majority of recycled plastic, the sheet of material woven with a flexible recycled material, the sheet of material including a single layer having a first side and an opposite second side, wherein the first side includes a first design and the second side includes a second design, wherein the sheet of material defines a perimeter having a laser cut edge, wherein the sheet of material is configured to cover an object and remain flat after the sheet is removed from the object, wherein the sheet of material is configured to be tied around the object without the use of a fastener, wherein the first design and the second design are different, wherein the flexible recycled material includes a recycled polyester and spandex material, wherein the flexible recycled material includes at least 70% of the recycled polyester, and wherein the sheet of material is configured to stretch to at least 40% of an initial dimension in a direction of pull without distortion of the first design and the second design.

8. The reuseable gift wrap of claim 7, wherein the flat sheet of material is square.

9. The reuseable gift wrap of claim 8, wherein the square is about 12"×12" to about 48"×48".

10. The reuseable gift wrap of claim 9, wherein the square is about 18"×18" to about 36"×36".

11. The reuseable gift wrap of claim 7, wherein the first design and the second design are different.

12. The reuseable gift wrap of claim 7, wherein the first design and the second design are generated with a dye sublimation process.

13. The reuseable gift wrap of claim 7, wherein the laser cut edge is hemless.

14. The reuseable gift wrap of claim 7, wherein the flat sheet of material is configured to cover an object without distortion of the first design and the second design after stretching to cover the object.

* * * * *